US005086616A

United States Patent [19]

Günkinger

[11] Patent Number: 5,086,616

[45] Date of Patent: Feb. 11, 1992

[54] TRANSPORT SYSTEM FOR PRODUCTION OF TEXTILE FILAMENT

[75] Inventor: Siegfried Günkinger, Heiningen, Fed. Rep. of Germany

[73] Assignee: Zinser Textilmaschinen GmbH, Ebersbach/Fils, Fed. Rep. of Germany

[21] Appl. No.: 557,215

[22] Filed: Jul. 23, 1990

[30] Foreign Application Priority Data

Jul. 22, 1989 [DE] Fed. Rep. of Germany ..... 3924274

[51] Int. Cl.[5] ..... D01H 9/18

[52] U.S. Cl. ..... 57/264; 19/159 A; 57/281

[58] Field of Search ..... 57/90, 263, 281, 264; 19/65 A, 159 R, 159 A

[56] References Cited

U.S. PATENT DOCUMENTS

| | | | |
|---|---|---|---|
| 3,698,041 | 10/1972 | Hertzsch | 19/159 A |
| 3,808,641 | 5/1974 | Schneider et al. | 19/159 A |
| 3,884,026 | 5/1975 | Yoshizawa et al. | 57/281 |
| 3,955,906 | 5/1976 | Murase et al. | 57/281 |
| 4,078,369 | 3/1978 | Brandis | 57/281 |
| 4,469,214 | 9/1984 | Maurer et al. | 57/281 |
| 4,528,721 | 7/1985 | Hera | 19/65 R |
| 4,697,310 | 10/1987 | Raasch | 19/159 A |
| 4,803,634 | 2/1989 | Ohno et al. . | |
| 4,984,335 | 1/1991 | Block | 19/65 R |
| 4,987,649 | 1/1991 | Meyer et al. | 19/159 A |

FOREIGN PATENT DOCUMENTS

| | | | |
|---|---|---|---|
| 0311831 | 4/1989 | European Pat. Off. . | |
| 83724 | 9/1970 | Fed. Rep. of Germany . | |
| 3524922 | 1/1987 | Fed. Rep. of Germany . | |
| 3621370 | 3/1987 | Fed. Rep. of Germany . | |
| 3618857 | 12/1987 | Fed. Rep. of Germany . | |
| 3634683 | 4/1988 | Fed. Rep. of Germany . | |
| 3809282 | 9/1989 | Fed. Rep. of Germany | 19/159 A |
| 389461 | 7/1965 | Switzerland . | |

OTHER PUBLICATIONS

Herbert Becker, "Interkama 80", VDI-Z 123 (1981) Nr. ½-Jan. (I/II). Bericht uber de 8.Intern. Kongress mit Austellung fuer Mess- und . . . .

*Primary Examiner*—Joseph J. Hail, III

*Attorney, Agent, or Firm*—Herbert Dubno; Andrew Wilford

[57] ABSTRACT

Empty and full containers are moved from and to a spinning apparatus having an input side having a waiting station for a full container, a working station for a container from which filament is withdrawn, and a takeoff station for an emptied container and an output side having a waiting station for an empty container, a working station where a container is filled with spun filament, and a takeoff station for full containers awaiting transport away. A sensor monitors the fullness of the container or containers at the input-side working station and generates an input-side working-station priority signal when the respective container is nearly empty and another sensor monitors the fullness of the container or containers at the output-side working station and generates an output-side working-station priority signal when the respective container is nearly full. The presence of containers at the input-side waiting station and output-side takeoff station is determined or detected by another sensors and respective input-side waiting-station and output-side take-off-station priority signals are generated when there is no container at the respective station. A computer-controlled transport-/control system immediately supplies a full container to the input-side waiting station on generation of both input-side priority signals and similarly immediately supplies an empty container to the output-side waiting station on generation of both output-side priority signals.

6 Claims, 3 Drawing Sheets

TRANSPORT SYSTEM FOR PRODUCTION OF TEXTILE FILAMENT

FIELD OF THE INVENTION

The present invention relates to a system for transporting filament in a textile plant. More particularly this invention concerns the movement of sliver, roving, and the like to and from a drawing frame, spinning apparatus, or the like.

BACKGROUND OF THE INVENTION

A standard filament-working machine such as a spinning apparatus takes a filament, roving or the like, out of a container, hereinafter referred to as a can, acts on it, and returns the treated filament to another can. Thus the machine typically has an input location that must be supplied with a succession of full cans of filament as cans are emptied and moved out of the way and an output location from which the full cans must be taken away and replaced with empty ones. For maximum efficiency it is imperative that the machine run continuously, to which end it is therefore necessary to make the changeover from one can to the next at both the input and output stations as quickly as possible.

In German patent document 3,634,683 filed Oct. 11, 1986 and assigned to Lippert GmbH a system is shown which has a transporter that extends between a drawing frame and a plurality of rotor-type spinning machines. The cans filled with filament at the drawing frame are conveyed by means of a transport device to one of the spinners and set down there. Subsequently empty cans are transported back from the spinners and refilled with filament. The transport device stays in position on the drawing frame with filled cans until a sensor determines that there is an empty can at a spinner whereupon the transporter moves to the empty-can location and switches the empty can for a full one.

To reduce switchover time it is standard to provide at each station one or more extra waiting positions where full cans may sit before they are needed or empty cans can sit before they are taken away. These waiting positions are tended automatically by a combination conveyor/transfer device. Swiss patent 389,461 filed Nov. 1, 1961 by I. Kaino et al describes such a system wherein once all the filament is removed from a row of cans, they are automatically transported away and replaced with a new row of filled cans.

German patent document 3,618,857 filed June 4, 1986 by F. Molders described a pivotal grab system that moves empty cans into the loading position of a spinning machine and full cans away from this machine. This arrangement facilitates automatic handling of such cans. Such a system, like the others above, relies on the conveyor being able to work so fast that it can keep ahead of the needs of the machines it is servicing no matter how quickly these machines operate.

OBJECTS OF THE INVENTION

It is therefore an object of the present invention to provide an improved system for moving filament cans in a textile plant.

Another object is the provision of such an improved system for moving filament cans in a textile plant which overcomes the above-given disadvantages, that is which automatically keeps the machine supplied with full cans of filament to be worked on and with empty cans to load the worked-on filament into.

SUMMARY OF THE INVENTION

Empty and full containers are moved from and to a spinning apparatus having an input side having a waiting station for a full container, a working station for a container from which filament is withdrawn, and a takeoff station for an emptied container and an output side having a waiting station for an empty container, a working station where a container is filled with spun filament, and a takeoff station for full containers awaiting transport away. The spinning apparatus has at each side a system for moving the respective containers from the respective waiting station through the respective working station to the respective takeoff station. A sensor monitors the fullness of the container or containers at the input-side working station and generates an input-side working-station priority signal when the respective container is nearly empty and another sensor monitors the fullness of the container or containers at the output-side working station and generates an output-side working-station priority signal when the respective container is nearly full. The presence of containers at the input-side waiting station and output-side takeof station is determined or detected by other sensors and respective input-side waiting-station and output-side takeoff-station priority signals are generated when there is no container at the respective station. A computer-controlled transport/control system immediately supplies a full container to the input-side waiting station on generation of both input-side priority signals and similarly immediately supplies an empty container to the output-side waiting station on generation of both output-side priority signals.

Thus with this system slack time is eliminated by establishing a priority in handling. The standard procedure of periodically transporting containers away from the takeoff stations and to the waiting stations is interrupted by giving priority to supplying of the containers to the waiting stations. Thus when not supplying containers to the waiting stations the machine tends to the less critical task of conveying containers away from the takeoff stations.

According to this invention the fullness of the containers is monitored by measuring the length of filament passing into and out of them. It can also be done by weighing the containers.

Furthermore according to this invention the priority signals are responded to in the order they are received, that is the first call for supply of a waiting station is taken care of before all others. Furthermore in accordance with this invention the presence of containers at the takeoff stations is detected and the containers are removed from the takeoff stations when their presence is detected except during supply of containers to the waiting stations.

DESCRIPTION OF THE DRAWING

The above and other objects, features, and advantages will become more readily apparent from the following, reference being made to the accompanying drawing in which.

SPECIFIC DESCRIPTION

Figure 1:
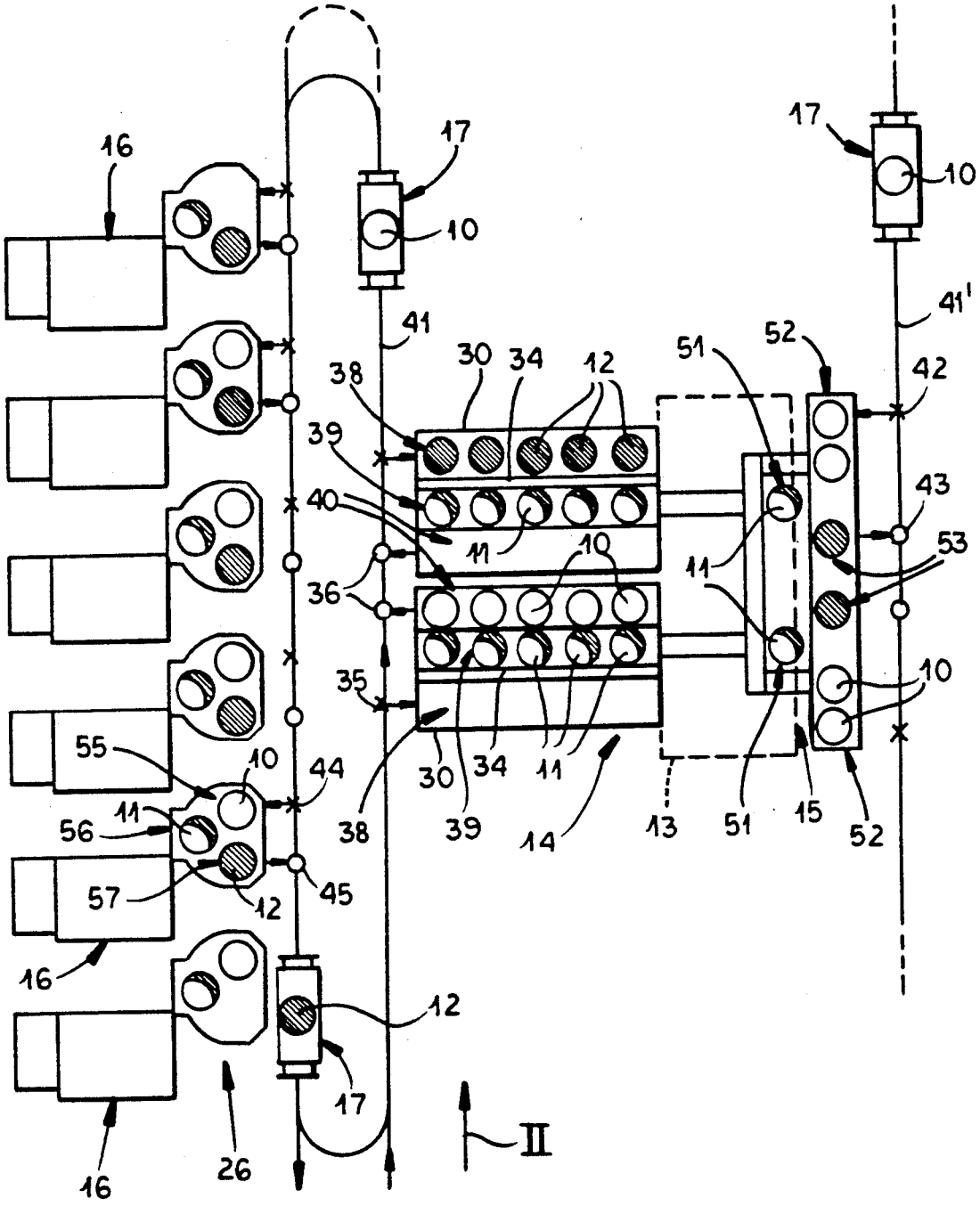
FIG. 1 is a largely diagrammatic top view of a system according to this invention.
Figure 2:
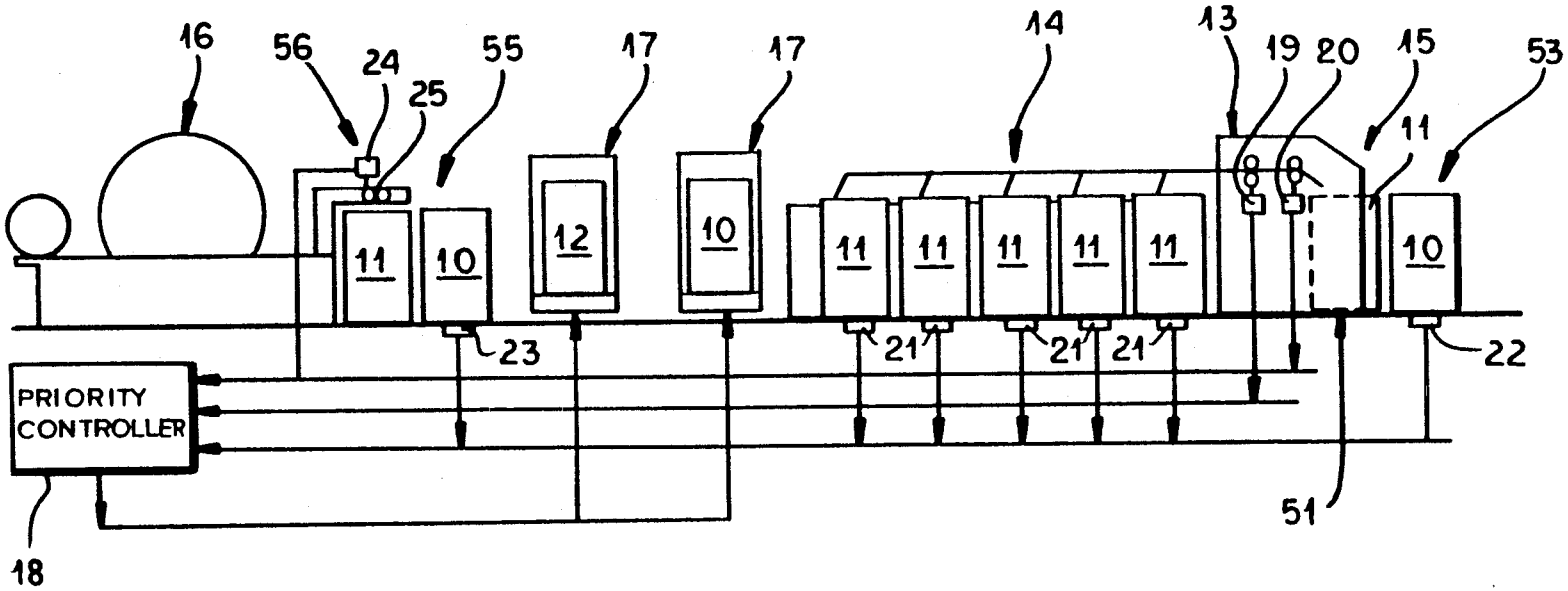
FIG. 2 is a side view taken in the direction of arrow II of FIG. 1.

As seen in FIGS. 1 and 2 a plurality of carding machines 16 each have an output side 26 in turn having a waiting station 55 normally holding an empty can 10, a working station 56 normally holding a partially full can 11, and a takeoff station 57 normally holding a completely full can 12. A device such as described in German patent document 3,618,857 serves for transfer from the station 56 to the station 57. Each carding machine 16 further has as seen in FIG. 2 a sliver feed 25 that delivers filament to the respective can 11 via a sensor 24 that measures how much sliver is in fact being fed to the can 11. Furthermore each station 55 and 57 is provided with a sensor 23 which detects the presence of a can 10 or 12 at the respective station. These sensors 23 and 24 are connected to a priority controller 18 that is also connected to a transport device 17 that moves along a path 41 through transfer positions 44 and 45 adjacent the stations 55 and 57, respectively. The transport device is of the type described in German patent documents 3,634,683 and 3,524,922, having a handler for moving the cans onto and off a wagon.

A drawing frame 13 adjacent the path 41 has an input side 14 and an output side 15 associated with respective input and output sensors 19 and 20. At the input side 14 there are tables 30 each provided with a service aisle 34 and each forming a waiting station 38 at which five full cans 12 can be held, a working station 39 at which five cans 11 are emptied, and a takeoff station 40 to which empty cans 10 are fed in the manner described in abovementioned Swiss patent 389,461. Empty containers 12 are moved at transfer stations 35 from the takeoff stations 40 and full ones are supplied at transfer stations 36 from the conveyor 17 along the path 41. Sensors 21 are provided for detecting the presence of the containers in the stations 38 and 40.

At the output side 15 there are empty containers 10 in waiting stations 52, partially full containers 11 in working stations 51, and full container in takeoff stations 53. Once again, a device such as described in German patent document 3,618,857 serves for transfer between the stations 51-53. Another or the same conveying device 17 can pass in a path 41' through transfer positions 42 and 43 adjacent the waiting and takeoff stations 52 and 53. Sensors 22 connected like the sensors 19 through 21 to the controller 18 and constituted, for example, as photoelectric light curtains or contacts, are provided at the stations 52 and 53 to detect the presence of cans at these locations.

In accordance with standard procedure in yarn or thread production, the carding machines 16 fill the cans with sliver. The filled cans 12 are then fed to the input side 14 of the drawing frames 13 where several, here five, slivers are combined and twisted together into a filament that is similarly loaded into cans at the output side 15. Thence the cans 12 of twisted filament are transported away for further processing. The controller 18 periodically moves full cans 12 from the stations 57 to the stations 38, empty cans 10 from the stations 40 to the stations 55, and supplies the stations 52 with empty cans 10 while taking full cans 12 away from the stations 53.

The sensors 19 and 20 according to this invention, which could be replaced by sensors which, instead of measuring length, measure weight or volume of the cans 11, provide outputs that allow the controller 18 to calculate when the respective cans 11 will be emptied or filled. As illustrated this is achieved by measuring filament length since this parameter if particularly pertinent to production both upstream and downstream. Thus the sensors 19 and 20 are in effect capable of forecasting when the respective partially filled cans 11 will be completely empty or completely full.

This information from the sensors 19 and 20 is combined with outputs from the critical sensors 21 and 22 which report the presence of full cans 12 in the waiting or ready stations 38 and empty cans 10 in the ready or waiting stations 52. In accordance with the invention when, for instance, one of the sensors 21 reports that there is a vacancy in the input-side waiting station 38 and the respective sensor 19 reports also that the respective can 11 is nearly empty, the controller 18 operates the conveyor 17 in priority mode to replenish the empty spot in the station 38. This replenishment, which is also handled on a priority basis for the station 52, takes precedence over any removal of cans from the stations 40 or 54.

The sensors 24 are similarly set up to forecast when the cans 11 will be full so that the controller 18 can similarly prioritize feeding empty cans 10 to the stations 55. The various priority signals are always put ahead of any signals regarding movements from any of the other stations. Each station is further assigned a code number so that the controller 18 can ascertain where to direct the device 17.

Figure 3:
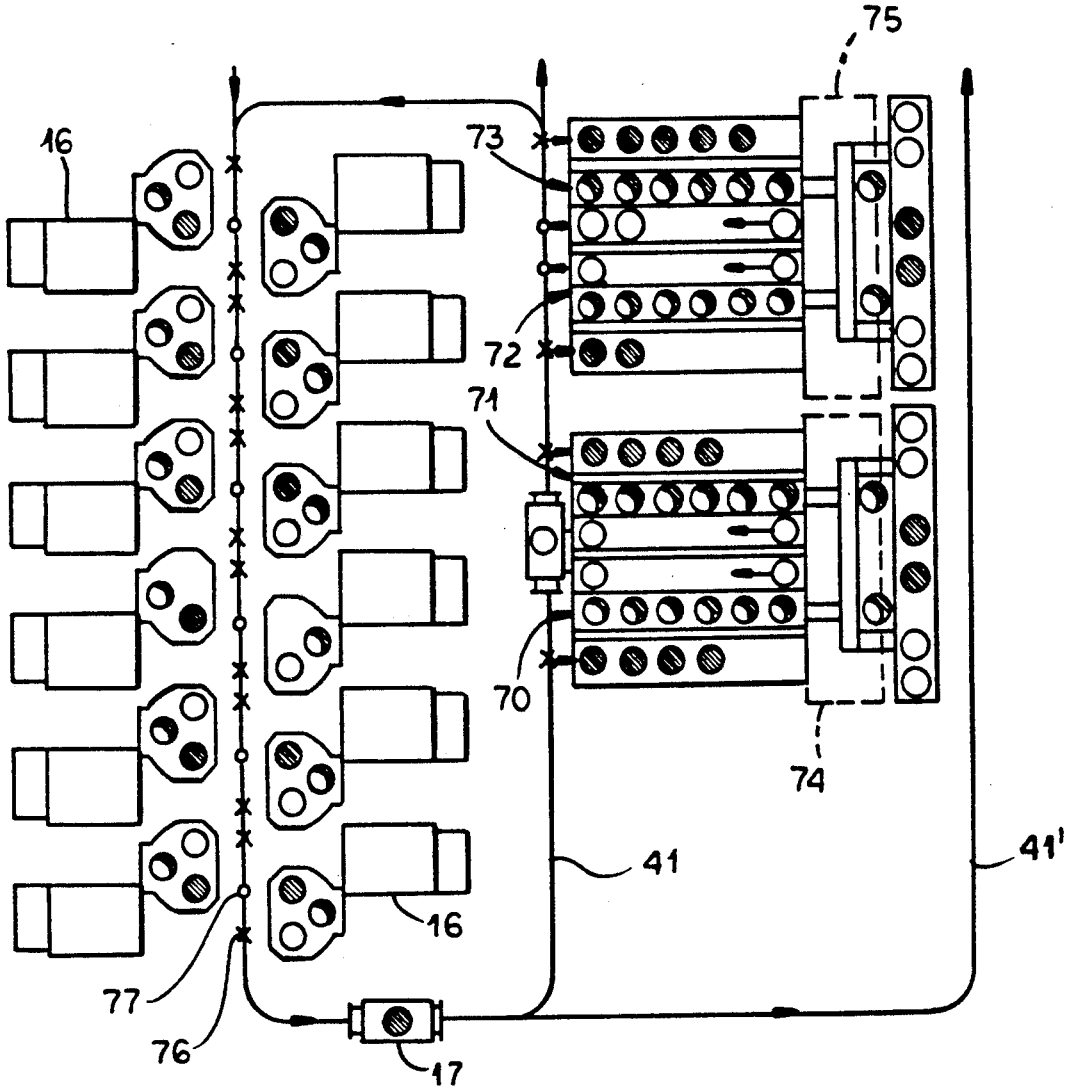
FIG. 3 is a view like FIG. 1 of an alternative arrangement in accordance with the present invention.

FIG. 3 shows an arrangement having a plurality of transfer stations 76 and 77 serving to transfer empty and full cans to and from the spinning apparatus. Several transporters 17 are used so as to increase the overall transport capacity. In this arrangement a priority-type controller is provided as in FIGS. 1 and 2. Cards 16 and drawing frames 74 are provided, with the cards 16 flanking a stretch of the path 41 and the path 41' forming a continuation of the annular path 41. Here as in FIGS. 1 and 2 the can can be replaced with other elements, for instance spools, and the filament treatment machines could be flyer-type spinners, winding devices, or the like.

I claim:

1. A method of moving empty and full containers from and to a spinning apparatus having an input side having a waiting station for a full container, a working station for a container from which filament is withdrawn, and a takeoff station for an emptied container and an output side having a waiting station for an empty container, a working station where a container is filled with spun filament, and a takeoff station for full containers awaiting transport away, the spinning apparatus having at each side a system for moving the respective containers from the respective waiting station through the respective working station to the respective takeoff station, the method comprising the steps of:

periodically transporting containers away from the takeoff stations;

monitoring the fullness of the container at the input-side working station and generating an input-side working-station priority signal when the respective container is nearly empty;

monitoring the fullness of the container at the output-side working station and generating a output-side working-station priority signal when the respective container is nearly full;

determining the presence of containers at the input-side waiting station and output-side takeoff station and generating respective input-side waiting-station and output-side takeoff-station priority signals when there is no container at the respective station;

interrupting periodic transport of containers away from the takeoff stations and immediately supplying a full container to the input-side waiting station on generation of both input-side priority signals; and interrupting periodic transport of containers away from the takeoff stations and immediately supplying an empty container to the output-side waiting station on generating of both output-side priority signals.

2. The method defined in claim 1 wherein the fullness of the containers is monitored by measuring the length of filament passing into and out of them.

3. The method defined in claim 1 wherein the fullness of the containers is monitored by weighing them.

4. The method defined in claim 1, further comprising the step of responding to the generation of the priority signals in the order they are received.

5. The method defined in claim 1, further comprising the steps of:

detecting the presence of containers at the takeoff stations and removing the containers from the takeoff stations when their presence is detected except during supply of containers to the waiting stations.

6. An apparatus for moving empty and full containers from and to a spinning apparatus having an input side having a waiting station for a full container, a working station for a container from which filament is withdrawn, and a takeoff station for an emptied container and an output side having a waiting station for an empty container, a working station where a container is filled with spun filament, and a takeoff station for full containers awaiting transport away, the spinning apparatus having at each side a system for moving the respective containers from the respective waiting station through the respective working station to the respective takeoff station, the apparatus comprising means including a sensor for monitoring the fullness of the container at the input-side working station and generating an input-side working-station priority signal when the respective container is nearly empty;

means including a sensor for monitoring the fullness of the container at the output-side working station and generating a output-side working-station priority signal when the respective container is nearly full;

means including respective sensors for determining the presence of containers at the input-side waiting station and output-side takeoff station and generating respective input-side waiting-station and output-side takeoff-station priority signals when there is no container at the respective station;

sensors at the takeoff stations for detecting the presence of containers thereat; and control and conveyor means for periodically transporting containers away from the takeoff stations, and interrupting period transport of containers away from the takeoff stations and immediately supplying a full container to the input-side waiting station on generation of both input-side priority signals and for immediately supplying an empty container to the output-side waiting station on generation of both output-side priority signals.

* * * * *